US009772146B2

(12) United States Patent
Hiwatashi et al.

(10) Patent No.: US 9,772,146 B2
(45) Date of Patent: Sep. 26, 2017

(54) PLATE HEAT EXCHANGER

(71) Applicants: HISAKA WORKS, LTD., Osaka-shi (JP); Hitachi-GE Nuclear Energy, Ltd., Hitachi-shi (JP)

(72) Inventors: Isamu Hiwatashi, Higashi-Osaka (JP); Mana Iwaki, Higashi-Osaka (JP); Kenji Kusunoki, Higashi-Osaka (JP); Kiyoshi Ishihama, Hitachi (JP); Seiichi Matsumura, Hitachi (JP); Yukiko Kushima, Hitachi (JP)

(73) Assignees: HISAKA WORKS, LTD., Osaka, Osaka (JP); Hitachi-GE Nuclear Energy, Ltd., Hitachi-shi, Ibaraki (JP)

( * ) Notice: Subject to any disclaimer, the term of this patent is extended or adjusted under 35 U.S.C. 154(b) by 604 days.

(21) Appl. No.: 14/357,007

(22) PCT Filed: Nov. 7, 2012

(86) PCT No.: PCT/JP2012/078891
§ 371 (c)(1),
(2) Date: May 8, 2014

(87) PCT Pub. No.: WO2013/069706
PCT Pub. Date: May 16, 2013

(65) Prior Publication Data

US 2014/0311724 A1 Oct. 23, 2014

(30) Foreign Application Priority Data

Nov. 11, 2011 (JP) ..... 2011-247552

(51) Int. Cl.

| | |
|---|---|
| ***F28F 3/08*** | (2006.01) |
| ***F28F 3/00*** | (2006.01) |
| ***F28D 9/00*** | (2006.01) |

(52) U.S. Cl.
CPC ..... *F28F 3/08* (2013.01); *F28D 9/005* (2013.01); *F28F 3/005* (2013.01); *F28F 2265/16* (2013.01)

(58) Field of Classification Search
CPC ..... F28F 3/08; F28F 3/005; F28F 2265/16; F28D 9/005

(Continued)

(56) References Cited

U.S. PATENT DOCUMENTS 4,903,758 A * 2/1990 Cowan ..... F28F 3/083 165/111
5,909,766 A * 6/1999 Kobayashi ..... F28F 3/005 165/153

(Continued)

FOREIGN PATENT DOCUMENTS

CN 2370371 Y 3/2000
CN 201233195 Y 5/2009

(Continued)

OTHER PUBLICATIONS

Office Action issued Aug. 20, 2015 in corresponding Chinese Application No. 201280054348.8.

(Continued)

*Primary Examiner* — Tho V Duong
(74) *Attorney, Agent, or Firm* — Knobbe, Martens, Olson & Bear LLP

(57) ABSTRACT

A flow-path forming gasket is interposed between peripheries of each adjacent ones of stacked heat transfer plates; communicating-path forming gaskets are each installed, surrounding the passage holes in each adjacent ones of the heat transfer plates alternately; and thereby a first flow path adapted to pass a high-temperature fluid, a second flow path adapted to pass a low-temperature fluid, and communicating paths adapted to cause the fluids, respectively, to flow in and (Continued)

out of the first and second flow paths are formed alternately on opposite sides of each heat transfer plate. A drain hole is formed in each of the heat transfer plates to discharge fluid leaking from the first flow path, the second flow path, or the communicating path. The drain hole is surrounded by gaskets isolated from the first flow path, the second flow path, or the communicating path. A leakage flow path or a leakage collector is formed by the gaskets.

6 Claims, 13 Drawing Sheets

(58) Field of Classification Search
USPC ..... 165/70
See application file for complete search history.

(56) References Cited

U.S. PATENT DOCUMENTS

| | | | | | |
|---|---|---|---|---|---|
| 5,913,361 | A * | 6/1999 | Engstrom | F28D 9/005 165/167 |
| 7,337,836 | B1 | 3/2008 | Persson | |
| 9,163,882 | B2 * | 10/2015 | Crawford | F28D 9/005 |
| 9,353,656 | B2 * | 5/2016 | Bauer | F01M 5/002 |
| 2009/0159251 | A1 | 6/2009 | Blomgren | |
| 2010/0300651 | A1 * | 12/2010 | Kumar | F28D 9/005 165/70 |

FOREIGN PATENT DOCUMENTS

| | | | |
|---|---|---|---|
| CN | 101484771 | A | 7/2009 |
| EP | 817948 | A | 1/1998 |
| JP | 55-145873 | A | 11/1980 |
| JP | 2-192598 | A | 7/1990 |
| JP | 5-79786 | A | 3/1993 |
| JP | 9-72686 | A | 3/1997 |
| JP | 09089478 | A * | 4/1997 |
| JP | 9-292193 | A | 11/1997 |
| JP | 11-503819 | A | 3/1999 |
| JP | 2000-283687 | A | 10/2000 |
| JP | 2005-69639 | A | 3/2005 |
| JP | 2008-51390 | A | 3/2008 |
| WO | 97/29336 | A | 8/1997 |
| WO | 2013/061966 | A1 | 2/2013 |

OTHER PUBLICATIONS

Extended European Search Report issued Jun. 6, 2015 in application No. 12848024.1.
Office Action issued Jan. 29, 2017 in corresponding JP Application No. 2013-543014.

* cited by examiner

PLATE HEAT EXCHANGER

CROSS REFERENCE TO RELATED APPLICATIONS

This application is the U.S. National Phase under 35. U.S.C. §371 of International Application PCT/JP2012/078891, filed Nov. 7, 2012, which claims the priority to Japanese Patent Application No. 2011-247552, filed Nov. 11, 2011. The disclosure of which is incorporated herein by reference in its entirety.

FIELD OF THE INVENTION

The present invention relates to a plate heat exchanger for exchanging heat between a high-temperature fluid and a low-temperature fluid. More particularly, the present invention relates to a plate heat exchanger in which by stacking plural heat transfer plates and interposing a gasket between peripheries or the like of each adjacent ones of the heat transfer plates, a flow path adapted to pass a high-temperature fluid and a flow path adapted to pass a low-temperature fluid are formed alternately between each adjacent heat transfer plates.

RELATED ART

In a plate heat exchanger, plural heat transfer plates 20 are stacked in an upright posture between a plate-shaped rectangular fixed frame 11 in an upright posture and a plate-shaped rectangular movable frame 12 in an upright posture as shown in FIG. 8, a first flow path 1 and a second flow path 2 are formed alternately between the heat transfer plates 20 as shown in FIG. 9, and a high-temperature fluid H is passed through the first flow path 1 while a low-temperature fluid C is passed through the second flow path 2, thereby exchanging heat between the high-temperature fluid H and low-temperature fluid C.

Passage holes 11*a* to 11*d* serving as inlet ports and outlet ports for the fluids H and C are provided in four corners of the fixed frame 11, whereas no passage hole is provided in the movable frame 12. Also, respective dedicated plates (hereinafter referred to as a "D plate" and "E plate") 20*d* and 20*e* are overlaid on the fixed frame 11 and the movable frame 12. Passage holes (not numbered) are provided in four corners of the D plate 20*d*, and a gasket (hereinafter referred to as a "D gasket") 140 is interposed between the D plate 20*d* and the fixed frame 11, surrounding the passage holes. Note that no passage hole is provided in the E plate 20*e*.

Also, passage holes 21 to 24 serving as inlet ports and outlet ports for the fluids H and C are provided in four corners of each of the heat transfer plates 20, a heat transfer portion (not numbered) is provided in an intermediate portion of the heat transfer plate 20, and a gasket 130 is interposed between each adjacent ones of the heat transfer plates 20, for example, such that the upper and lower left passage holes 21 and 22 are communicated with the heat transfer portion while the upper and lower right passage holes 23 and 24 are closed to the heat transfer portion, or vice versa.

The gasket 130 is made up of a flow-path forming gasket 131 configured to surround a periphery (inner side of an outer peripheral edge) of each heat transfer plate 20 and communicating-path forming gaskets 132 configured to surround circumferences of the passage holes 21 to 24, where the flow-path forming gasket 131 and communicating-path forming gaskets 132 may be formed either separately or integrally (not shown).

In the plate heat exchanger, the upper and lower right communicating-path forming gaskets 132 surround the upper and lower right passage holes 23 and 24, thereby forming communicating paths 3 isolated from the upper and lower left passage holes 21 and 22 as well as from the first flow path 1. Also, in the plate heat exchanger, the flow-path forming gasket 131 surrounds the upper and lower left passage holes 21 and 22 as well as the heat transfer portion, thereby forming a first flow path 1 adapted to pass the high-temperature fluid H.

Also, in the plate heat exchanger, the upper and lower left communicating-path forming gaskets 132 surround the upper and lower left passage holes 21 and 22, thereby forming communicating paths 3 isolated from the upper and lower right passage holes 23 and 24 as well as from the second flow path 2. Also, in the plate heat exchanger, the flow-path forming gasket 131 surrounds the upper and lower right passage holes 23 and 24 as well as the heat transfer portion, thereby forming a second flow path 2 adapted to pass the low-temperature fluid C.

Thus, in FIG. 9, the high-temperature fluid H flows downward through the first flow path 1 from the upper left passage hole 21 and is discharged through the lower left passage hole 22 while the low-temperature fluid C flows upward through the second flow path 2 from the lower right passage hole 24 and is discharged through the upper right passage hole 23, thereby exchanging heat between the two fluids H and C.

On the other hand, Patent Literature 1 describes a plate heat exchanger comprising a flow-path forming gasket and a communicating-path forming gasket which are integrated into a single gasket and interposed between heat transfer plates, in which part of the flow-path forming gasket and part of the communicating-path forming gasket are arranged side-by-side to provide double (two) gaskets in a border between a heat transfer portion and passage holes. In the plate heat exchanger, the double gaskets are firmly fixed to the heat transfer plates without using an adhesive and in other part, the gasket is bonded to the heat transfer plates using an adhesive.

The double gaskets are interposed in a space between every other pair of the stacked heat transfer plates (alternately), thereby forming a flow path configured to communicate the heat transfer portion and passage holes without double gaskets. Those heat transfer plates which lack double gaskets are subject to deformation due to internal pressure, but since the double gaskets are not bonded to the heat transfer plates with an adhesive, pressure tightness of the plate heat exchanger is improved.

CITATION LIST

Patent Literature

Patent Literature 1: JP 9-72686 A

However, the conventional plate heat exchanger shown above in FIGS. 8 and 9 have problems as described below.

With the plate heat exchanger, at a trial run stage immediately after assembly, the fluids H and C may sometimes leak from the gasket 130. The fluids H and C may leak from the gasket 130, for example, due to cracks or abnormal physical properties resulting from contamination with foreign matter or faulty joining during the manufacture of the gasket 130; due to positional displacement of the gasket 130 heated or pressurized by the high-temperature fluid H; due to faulty mounting caused when the gasket 130 bites into foreign matter; or due to swelling of the gasket 130. Such leakage of the fluids H and C may occur in an initial stage when the plate heat exchanger is installed and involve large amounts of leakage as well, and thus can be detected easily.

However, since the gasket 130 which passes the high-temperature fluid H, in particular, has its inner side exposed to the high-temperature fluid H, and its outer side exposed to the atmosphere, the high-temperature fluid H may sometimes leak from the gasket 130 because of intensified settling or subsidence due to aging degradation and crack development due to oxidative degradation in a thermal load environment.

Besides, it is not only difficult, due to differences in the quality of the gasket 130, the installation environment of the plate heat exchanger, and operating conditions, to predict the time at which the fluids H and C will leak, but also difficult to predict leakage of the fluids H and C in a timely manner due to slight amounts of leakage which appears as seepage. Further, when the high-temperature fluid H is a dangerous chemical solution, leaking out of the high-temperature fluid H from the plate heat exchanger may cause secondary accidents.

If the gaskets 130 are replaced a little earlier so that the fluids H and C will not leak outside, this will increase running costs. Also, a method is conceivable which prevents the high-temperature fluid H from flowing out, by covering the entire plate heat exchanger with an watertight sheet or the like or inserting rubber or the like into gaps among outer peripheral portions of the stacked heat transfer plates, but such a method is not adopted because of problems in terms of costs and quality.

Also, with the plate heat exchanger described in Patent Literature 1, part of the flow-path forming gasket as well as part of the communicating-path forming gasket are arranged in two lines in the border between the heat transfer portion and passage holes. However, since the flow-path forming gasket through which the high-temperature fluid flows is not arranged in two lines, the high-temperature fluid may leak outside at an early stage due to progress in oxidative degradation of the flow-path forming gasket or the like.

DISCLOSURE OF THE INVENTION

Problems to be Solved by the Invention

Thus, an object of the present invention is to provide a plate heat exchanger capable of easily detecting any leakage of a high-temperature fluid caused by degradation of a gasket before the high-temperature fluid leaks out of the plate heat exchanger.

Means for Solving Problems

In a plate heat exchanger according to the present invention, a plurality of heat transfer plates are stacked, each being provided with a plurality of passage holes; a flow-path forming gasket is interposed between peripheries of each adjacent ones of the plurality of heat transfer plates, thereby alternately forming a first flow path adapted to pass a high-temperature fluid and a second fluid flow path adapted to pass a low-temperature fluid on opposite sides of each heat transfer plate; communicating-path forming gaskets surrounding the passage holes are each interposed between each adjacent ones of the plurality of heat transfer plates, thereby forming a communicating path adapted to cause a fluid to flow in and out of the first flow path and a communicating path adapted to cause a fluid to flow in and out the second flow path; a drain hole is formed in each of the heat transfer plates to discharge fluid leaking from the first flow path, the second flow path, or the communicating path; and the drain hole is surrounded by a plurality of gaskets, forming a leakage flow path or a leakage collector isolated from the first flow path, the second flow path, or the communicating path.

Here, as one aspect of the plate heat exchanger according to the present invention, a configuration can be adopted in which an entire circumference of a first flow-path forming gasket which forms the first flow path is surrounded by a peripheral gasket; and the leakage flow path is formed between the first flow-path forming gasket and the peripheral gasket.

Also, as another aspect of the plate heat exchanger according to the present invention, a configuration can be adopted in which the communicating-path forming gaskets are surrounded by a second flow-path forming gasket adapted to form the second flow path and a local gasket; and the leakage collector is formed among the communicating-path forming gaskets, the second flow-path forming gasket, and the local gasket.

Also, as still another aspect of the plate heat exchanger according to the present invention, a configuration can be adopted in which each of the communicating-path forming gaskets is a double-line gasket made up of an inner gasket member and an outer gasket member; the drain hole is formed between the inner gasket member and the outer gasket member; the leakage flow path is provided between the inner gasket member and the outer gasket member; and the drain holes exposed to the first flow path or the second flow path by being located next to the leakage flow path are communicated together by an annular gasket.

Also, as still another aspect of the plate heat exchanger according to the present invention, a configuration can be adopted in which a fluid supply hole is formed in the heat transfer plate to supply a third fluid into the leakage flow path or the leakage collector.

Also, as still another aspect of the plate heat exchanger according to the present invention, a configuration can be adopted in which a drain channel continuous with the drain hole is formed in one of a fixed frame and a movable frame which sandwich the plurality of stacked heat transfer plates; a drain nozzle is mounted on the drain channel; and a sensor adapted to detect a fluid is connected to the drain nozzle.

Also, as still another aspect of the plate heat exchanger according to the present invention, a configuration can be adopted in which the passage holes are formed in respective corners of the heat transfer plate.

Also, as still another aspect of the plate heat exchanger according to the present invention, a configuration can be adopted in which the passage holes are formed generally in a line in a length direction of the heat transfer plate.

DESCRIPTION OF EMBODIMENTS

First Embodiment

Figure 1:
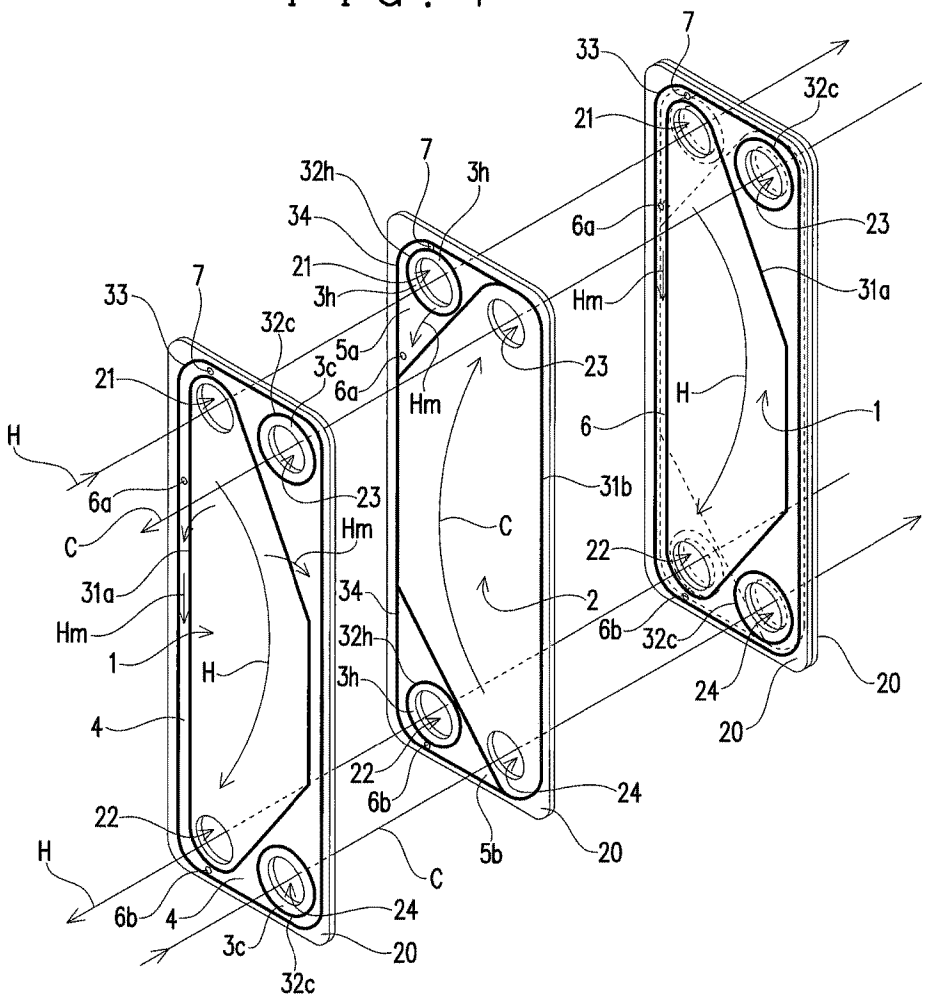
FIG. 1 is a schematic exploded perspective view showing principal part of a plate heat exchanger according to a first embodiment of the present invention.

A plate heat exchanger according to a first embodiment of the present invention is described below with reference to FIGS. 1 and 2. The same components as in conventional components are denoted by the same reference numerals as the corresponding conventional components. In the following description, positional terms such as upper, lower, right, and left are exemplary in each embodiment, and, needless to say, may represent different positions depending on actual usage.

Figure 2:
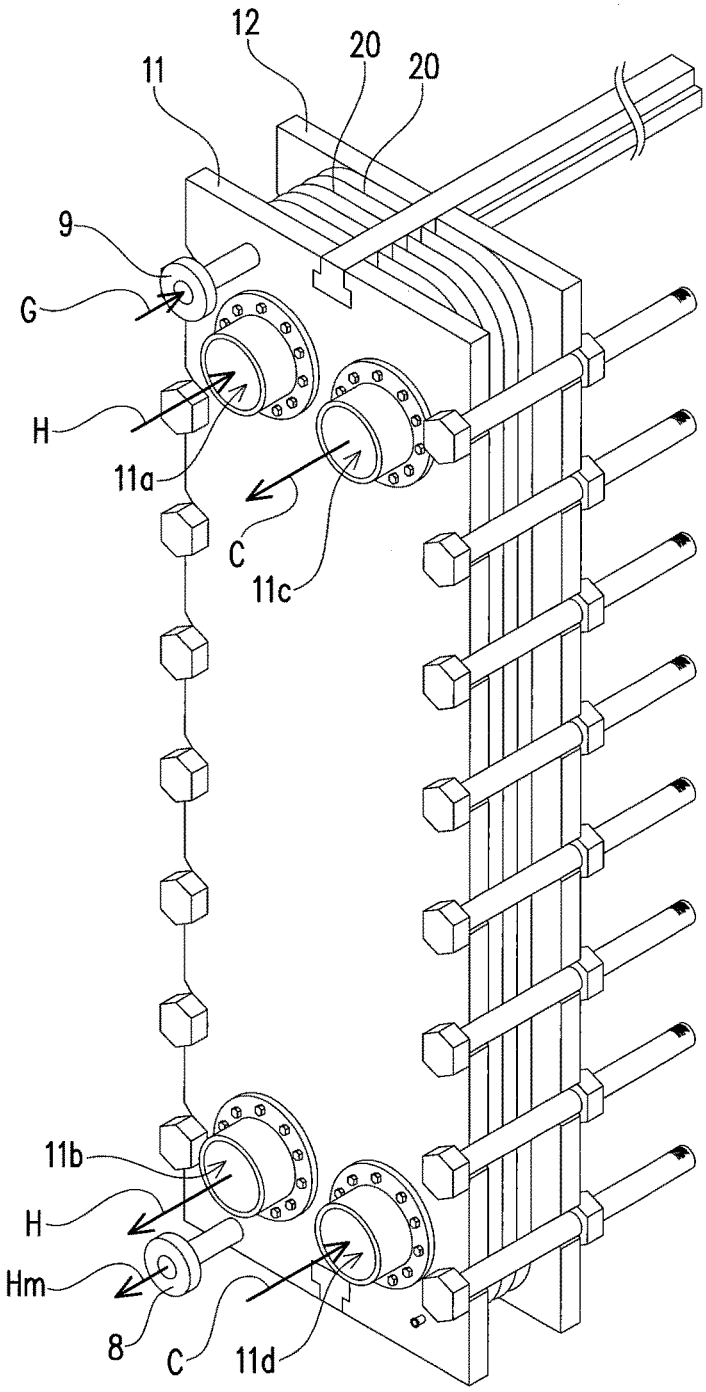
FIG. 2 is a schematic perspective view showing the plate heat exchanger according to the first embodiment of the present invention.

As is conventionally the case, the plate heat exchanger according to the first embodiment is an apparatus in which a first flow path 1 and a second flow path 2 are formed alternately between heat transfer plates 20 as shown in FIG. 1, and a high-temperature fluid H is passed through the first flow path 1 while a low-temperature fluid C is passed through the second flow path 2. That is, the first flow path 1 adapted to pass the high-temperature fluid H and the second flow path 2 adapted to pass the low-temperature fluid C are formed alternately on opposite sides of each heat transfer plate 20.

The first flow path 1 is formed by a first flow-path forming gasket 31*a* which surrounds upper and lower left passage holes 21 and 22 and a heat transfer portion (trapezoidal shape in figures) of the heat transfer plate 20. Then, low-temperature-fluid communicating paths 3*c* are formed by low-temperature-fluid communicating-path forming gaskets 32*c* which surround upper and lower right passage holes 23 and 24 of the heat transfer plate 20, respectively.

As the low-temperature-fluid communicating-path forming gaskets 32*c* are interposed between the heat transfer plates 20 which form the first flow path 1, the low-temperature fluid C is supplied into the second flow path 2 from below without flowing between the heat transfer plates 20 which form the first flow path 1 and discharged from an upper side of the second flow path 2.

An entire circumference of the first flow-path forming gasket 31*a* as well as the two low-temperature-fluid communicating-path forming gaskets 32*c* are surrounded by a peripheral gasket 33 interposed along an outer peripheral edges of the heat transfer plate 20, and a leakage flow path 4 is provided between the peripheral gasket 33 and a set of gaskets made up of the first flow-path forming gasket 31*a* and the two low-temperature-fluid communicating-path forming gaskets 32*c*.

The second flow path 2 is formed by a second flow-path forming gasket 31*b* which surrounds the upper and lower right passage holes 23 and 24 and the heat transfer portion (trapezoidal shape in figures) of the heat transfer plate 20 adjacent to the aforesaid heat transfer plate 20. Also, high-temperature-fluid communicating paths 3*h* are formed by high-temperature-fluid communicating-path forming gaskets 32*h* which surround the upper and lower left passage holes 21 and 22 of this heat transfer plate 20, respectively.

As the high-temperature-fluid communicating-path forming gaskets 32*h* are interposed between the heat transfer plates 20 which form the second flow path 2, the high-temperature fluid H is supplied into the first flow path 1 from above without flowing between the heat transfer plates 20 which form the second flow path 2 and discharged from a lower side of the first flow path 1.

The high-temperature-fluid communicating-path forming gaskets 32*h* are surrounded by a local gasket 34 and part of the second flow-path forming gasket 31*b* (that portion which is inclined in close vicinity to the high-temperature-fluid communicating-path forming gaskets 32*h*, in figures) and first and second leakage collectors 5*a* and 5*b* (triangular shape in figures) are provided among the gaskets 32*h*, 34, and 31*b* to collect high-temperature fluid Hm leaking from the high-temperature-fluid communicating-path forming gaskets 32*h*.

Also, a drain hole (hereinafter referred to as a "first drain hole") 6*a* is formed in lower end part of the first leakage collector 5*a* by penetrating the heat transfer plate 20 in order for the high-temperature fluid Hm leaking into the first leakage collector 5*a* to be discharged into the leakage flow path 4.

Besides, a drain hole (hereinafter referred to as a "second drain hole") 6*b* is formed in lower end part of the leakage flow path 4 in order for the high-temperature fluid Hm flowing down in the leakage flow path 4 to be discharged therethrough. By penetrating the heat transfer plate 20, the second drain hole 6*b* is communicated with the leakage flow path 4 and the second leakage collector 5*b* placed next to each other via the heat transfer plate 20.

Therefore, the second drain hole 6*b* is continuous among adjacent heat transfer plates 20. Also, a drain channel (not numbered) through which the leaking high-temperature fluid Hm flows is installed such that the second drain hole 6*b* is made to be continuous. Also, a drain hole (not shown) continuous with the drain channel is formed on the fixed frame 11 and a drain nozzle 8 is mounted in the drain hole as shown in FIG. 2.

Sensors (not shown) adapted to detect the temperature, pressure, leakage amount, liquid components, and the like of the leaking high-temperature fluid Hm are mounted on the drain nozzle 8 according to needs and circumstances. Sensors adapted to convert the temperature or the like into electrical signals may be used for that, and a system adapted to send the electrical signals may be constructed in an administration office.

Furthermore, in the first leakage collector 5*a*, a third fluid supply hole 7 communicated with the leakage flow path 4 is formed by penetrating the heat transfer plate 20. The third fluid supply hole 7 is formed in a portion where the leakage flow path 4 formed between the adjacent heat transfer plates 20 overlaps the first leakage collector 5*a*, i.e., in upper part of the heat transfer plates 20. A third fluid supply hole (not shown) is formed also in the fixed frame 11, and a third fluid supply nozzle 9 is mounted in the third fluid supply hole 7 as shown in FIG. 2.

An inert gas such as nitrogen or a fluid such as pure water is supplied from the third fluid supply nozzle 9 into the leakage flow path 4 and the first and second leakage collectors 5*a* and 5*b* through the third fluid supply hole 7 to expel oxygen from the air initially existing in this space and thereby protect entire areas of the gaskets 31*a*, 32*h*, and 32*c* and inner sides of the gaskets 31*b*, 33, and 34 from oxidation. The third fluid supply hole 7 is formed at such a location as to be used as the second drain hole 6*b* when the heat transfer plate 20 is assembled upside down.

With the first and second drain holes 6*a* and 6*b* formed in the heat transfer plates 20 and with the first and second leakage collectors 5*a* and 5*b* provided in this way, the plate heat exchanger according to the first embodiment also exchanges heat between the high-temperature fluid H flowing through the first flow paths 1 and the low-temperature fluid C flowing through the second flow paths 2.

Then, when any of the first flow paths 1 and the high-temperature-fluid communicating-path forming gaskets 32*h* in contact with the high-temperature fluid H degrade in a thermal load environment, the plate heat exchanger according to the first embodiment enables ease of determination through detection of the leaking high-temperature fluid Hm, that leakage of the high-temperature fluid Hm has occurred.

That is, when any of the first flow-path forming gaskets 31*a* degrades, the high-temperature fluid Hm leaks out of the first flow-path forming gasket 31*a* into the leakage flow path 4. Also, when any of the high-temperature-fluid communicating-path forming gaskets 32*h* degrades, the leaking high-temperature fluid Hm leaks out of the high-temperature-fluid communicating path 3*h* into the leakage flow path 4 through the first drain hole 6*a* formed in the first leakage collector 5*a*.

Then, the high-temperature fluid Hm leaking out into the leakage flow path 4 passes through the second drain hole 6*b* and the drain channel and is discharged through the drain nozzle 8. Therefore, by detecting that the high-temperature fluid Hm is being discharged through the drain nozzle 8, it is possible to determine that leakage of the high-temperature fluid Hm has occurred due to degradation of the first flow-path forming gasket 31*a* or the high-temperature-fluid communicating-path forming gasket 32*h*.

Note that when pure water is constantly supplied from the third fluid supply nozzle 9, the pure water is discharged constantly through the drain nozzle 8. Pure water and leaking high-temperature fluid Hm can be distinguished by a sensor, and thus by detecting that high-temperature fluid Hm is being discharged through the drain nozzle 8, it is possible to determine that leakage of the high-temperature fluid Hm has occurred due to degradation of the first flow-path forming gasket 31*a* or the high-temperature-fluid communicating-path forming gasket 32*h*.

Second Embodiment

Figure 3:
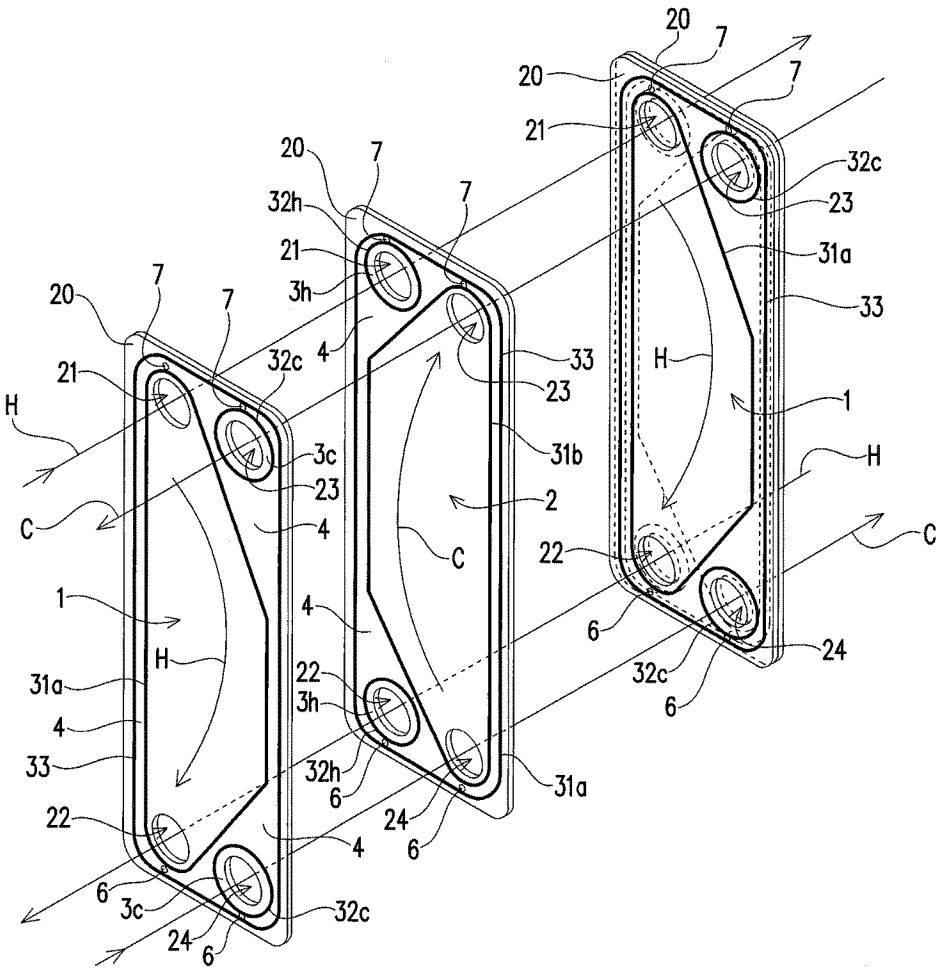
FIG. 3 is a schematic exploded perspective view showing principal part of the plate heat exchanger according to a second embodiment of the present invention.

Next, a plate heat exchanger according to a second embodiment of the present invention is described with reference to FIG. 3. The same components as in the first embodiment are denoted by the same reference numerals as the corresponding components of the first embodiment.

As with the first embodiment, the plate heat exchanger according to the second embodiment is configured such that the peripheral gasket 33 is interposed along the outer peripheral edges of each heat transfer plate 20. The peripheral gasket 33 surrounds the entire circumference of the first flow-path forming gasket 31*a* as well as the two low-temperature-fluid communicating-path forming gaskets 32*c*, and the leakage flow path 4 is not only provided, but also installed by surrounding the entire circumference of the second flow-path forming gasket 31*b* as well as the two high-temperature-fluid communicating-path forming gaskets 32*h*.

That is, in the plate heat exchanger according to the second embodiment, the second flow-path forming gasket 31*b* surrounds (trapezoidally in figures) the upper and lower right passage holes 23 and 24 and heat transfer portion of the heat transfer plate 20, forming the second flow path 2. Also, the high-temperature-fluid communicating-path forming gaskets 32*h* surround the upper and lower left passage holes 21 and 22, thereby forming the high-temperature-fluid communicating paths 3*h*. Then, the leakage flow path 4 is provided between the peripheral gasket 33 and a set of gaskets made up of the second flow-path forming gasket 31*b* and the two high-temperature-fluid communicating-path forming gaskets 32*h*.

Thus, in the second embodiment, first and second leakage collectors 5*a* and 5*b* such as those of the first embodiment are not provided, the first flow-path forming gasket 31*a* and the second flow-path forming gasket 31*b* are shaped to be bilaterally symmetrical, and the low-temperature-fluid communicating-path forming gaskets 32*c* and the high-temperature-fluid communicating-path forming gaskets 32*h* are interposed bilaterally symmetrically.

However, in the second embodiment, as with the first embodiment, drain holes 6 are formed in the lower part of the leakage flow path 4, penetrating the heat transfer plate 20, and the third fluid supply holes 7 are formed in the upper part of the leakage flow path 4, penetrating the heat transfer plate 20. Plural drain holes 6 and plural third fluid supply holes 7 can be formed in desired locations of the leakage flow path 4, but preferably the drain holes 6 and the third fluid supply holes 7 are formed vertically symmetrically with respect to a horizontal center axis serving as an axis of symmetry such that the drain holes 6 and third fluid supply holes 7 can be interchanged when the heat transfer plate 20 is assembled upside down.

Also, between each adjacent heat transfer plates 20, the drain holes 6 make up a drain channel (not numbered) through which the leaking high-temperature fluid Hm flows. Also, between each adjacent heat transfer plates 20, the third fluid supply holes 7 make up a third fluid supply path (not numbered) through which the leaking high-temperature fluid Hm flows.

Although not illustrated, as with the first embodiment, drain holes and third fluid supply holes continuous with the drain channel and the third fluid supply path respectively are formed also in the fixed frame 11 and the drain nozzles and the third fluid supply nozzles are mounted in the drain holes and the third fluid supply holes, respectively. Even if plural drain holes and plural third fluid supply holes are formed, a single drain nozzle and a single third fluid supply nozzle may be mounted.

The plate heat exchanger according to the second embodiment also exchanges heat between the high-temperature fluid H flowing through the first flow paths 1 and the low-temperature fluid C flowing through the second flow paths 2. Then, when the first flow-path forming gaskets 31*a* and the high-temperature-fluid communicating-path forming gaskets 32*h* in contact with the high-temperature fluid H degrade in a thermal load environment, it is possible to easily determine, by detecting the leaking high-temperature fluid Hm, that leakage of the high-temperature fluid Hm has occurred.

That is, when the first flow-path forming gaskets 31*a* and the high-temperature-fluid communicating-path forming gaskets 32*h* degrade by being placed in contact with the high-temperature fluid H, the high-temperature fluid Hm flows down into the leakage flow path 4 from the first flow-path forming gaskets 31*a* and the high-temperature-fluid communicating-path forming gaskets 32*h*, and then the leaking high-temperature fluid Hm is discharged through the drain nozzle after passing through the drain holes 6 and the drain channel. By detecting the discharged high-temperature fluid Hm, it is possible to determine that leakage of the high-temperature fluid Hm has occurred due to degradation of the first flow-path forming gaskets 31*a* and the high-temperature-fluid communicating-path forming gaskets 32*h*.

An inert gas such as nitrogen or pure water is supplied from supply nozzles to expel the air initially existing in the leakage flow path 4 and thereby protect the gaskets 31*a*, 31*b*, 32*a*, 32*c*, 32*h*, and 33 from oxidation. Even if pure water is supplied constantly, the leaking high-temperature fluid Hm flowing out through the drain holes 6 can be identified and detected by a sensor.

Third Embodiment

Figure 5A:
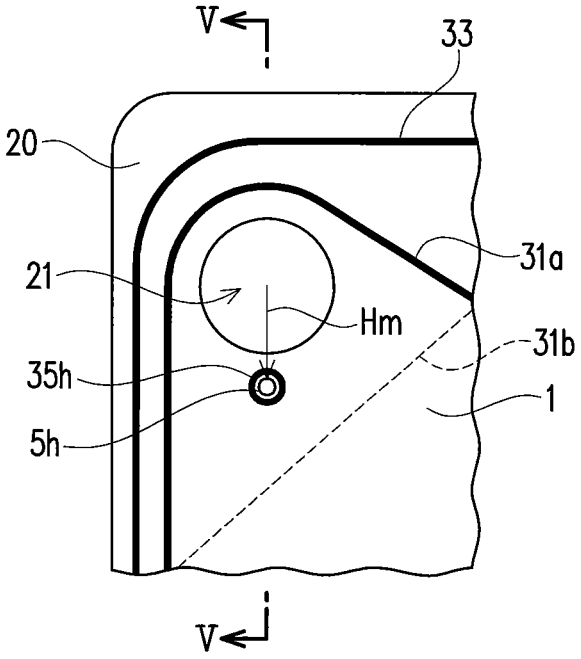
FIG. 5A is an enlarged plan view showing principal part in the upper left of the plate heat exchanger according to the third embodiment of the present invention.
Figure 5B:
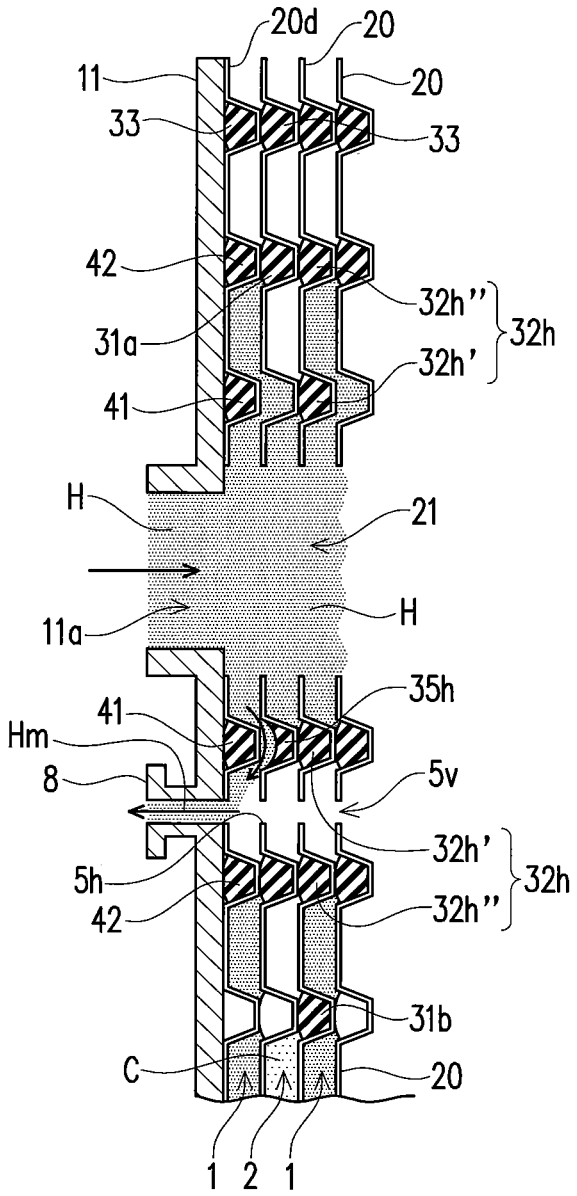
FIG. 5B is an enlarged sectional view of the plate heat exchanger according to the third embodiment of the present invention taken along line V-V in FIG. 5A.
Figure 5C:
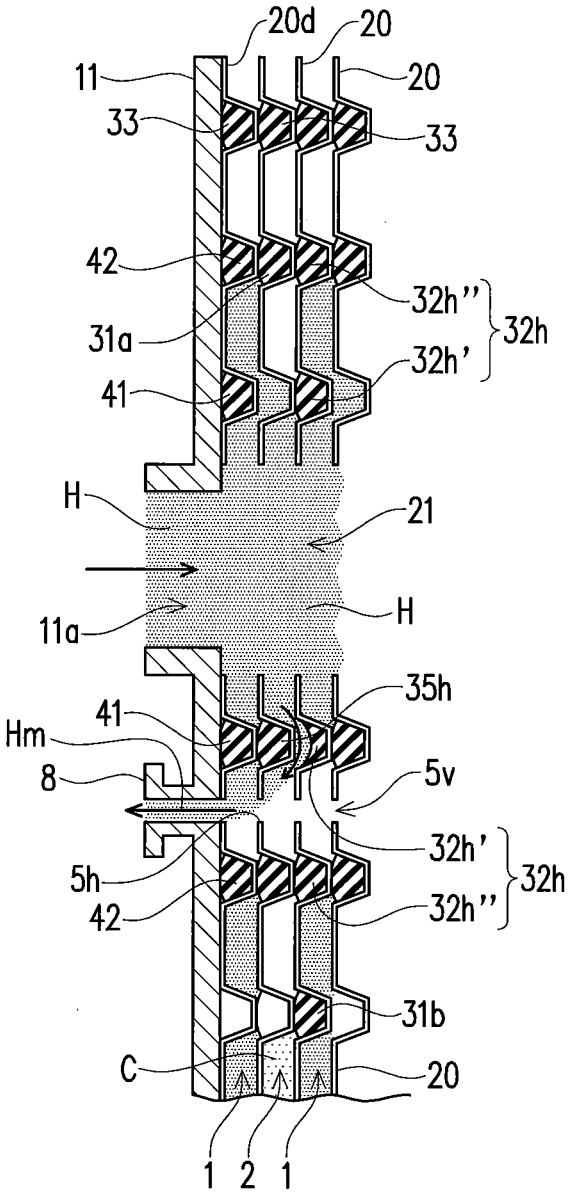
FIG. 5C is an enlarged sectional view of the plate heat exchanger according to the third embodiment of the present invention taken along line V-V in FIG. 5A.
Figure 6A:
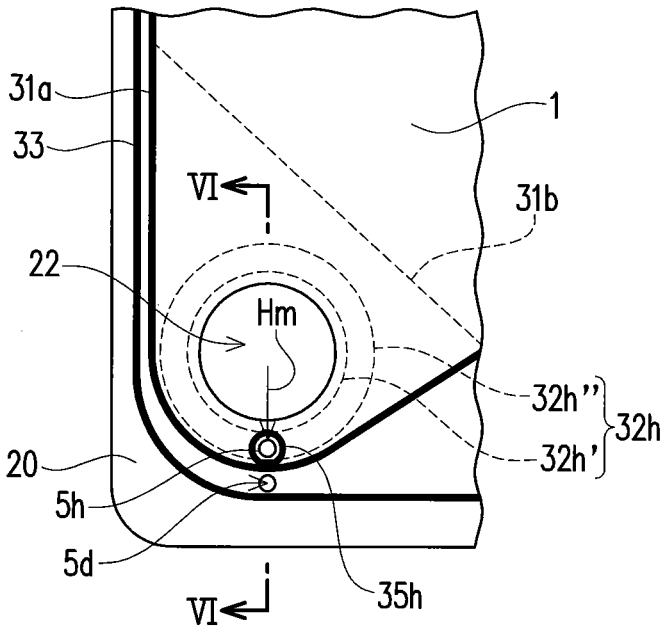
FIG. 6A is an enlarged plan view showing principal part in the lower left of the plate heat exchanger according to the third embodiment of the present invention.
Figure 6B:
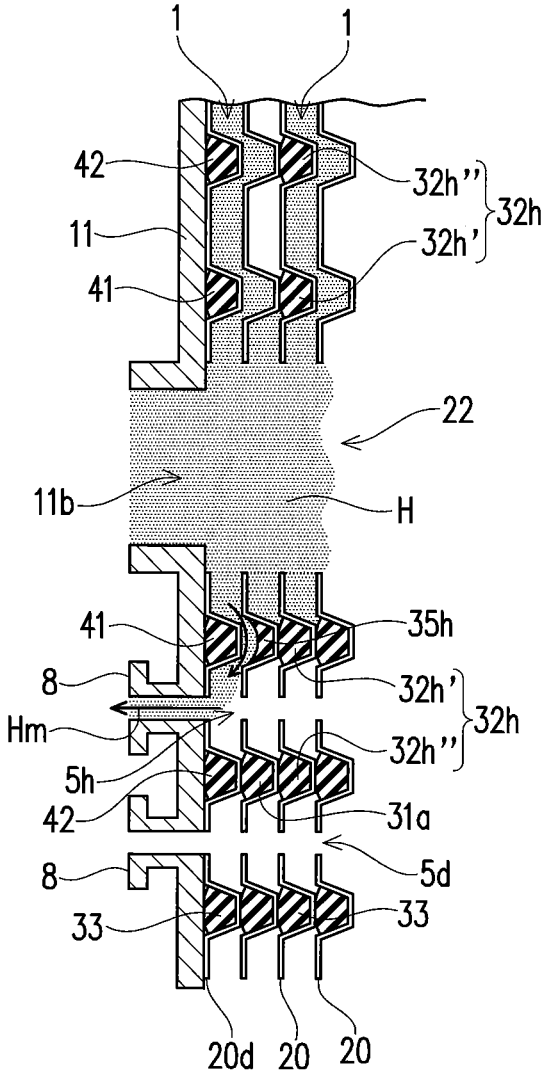
FIG. 6B is an enlarged sectional view of the plate heat exchanger according to the third embodiment of the present invention taken along line VI-VI in FIG. 6A.
Figure 6C:
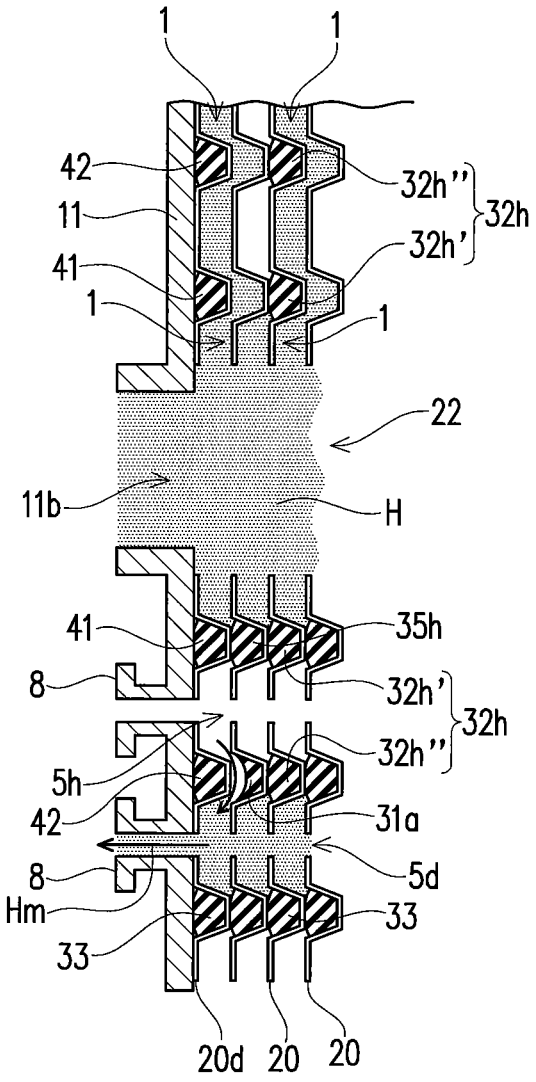
FIG. 6C is an enlarged sectional view of the plate heat exchanger according to the third embodiment of the present invention taken along line VI-VI in FIG. 6A.

Next, a plate heat exchanger according to a third embodiment of the present invention is described below with reference to FIGS. 4 to 6. The same components as in the first and second embodiments are denoted by the same reference numerals as the corresponding components of the first and second embodiments. FIGS. 5B and 5C show how the passage hole 21 is surrounded by double D gaskets 41 and 42 interposed between the fixed frame 11 and a D plate 20*d* while FIGS. 6B and 6C show how the passage hole 22 is surrounded by the double D gaskets 41 and 42 interposed between the fixed frame 11 and a D plate 20*d* as well.

In the plate heat exchanger according to the third embodiment, as with the plate heat exchanger according to the second embodiment, the peripheral gasket 33 interposed along outer peripheries of each heat transfer plates 20 surrounds the first flow-path forming gasket 31*a* and the two low-temperature-fluid communicating-path forming gaskets 32*c*, while the peripheral gasket 33 interposed between each adjacent ones of the heat transfer plates 20 surrounds the second flow-path forming gasket 31*b* and the two high-temperature-fluid communicating-path forming gaskets 32*h*.

According to the third embodiment, both the low-temperature-fluid communicating-path forming gasket 32*c* and the high-temperature-fluid communicating-path forming gasket 32*h* are double-line gaskets made up of an inner gasket member 32*c*' or 32*h*' and an outer gasket member 32*c*" or 32*h*' and a low-temperature fluid drain hole 5*c* and a high-temperature fluid drain hole 5*h* are formed between each pair of the gasket members 32*c*' and 32*c*" and between each pair of the gasket members 32*h*' and 32*h*," respectively, penetrating the heat transfer plate 20. The low-temperature fluid drain holes 5*c* and the high-temperature fluid drain holes 5*h* are formed below the passage holes 21 to 24.

Therefore, to keep the low-temperature fluid drain holes 5*c* from being exposed in the second flow path 2, the low-temperature fluid drain holes 5*c* are communicated together by annular gaskets 35*c* interposed between the heat transfer plates 20 which form the second flow path 2. Also, to keep the high-temperature fluid drain holes 5*h* from being exposed in the first flow path 1, the high-temperature fluid drain holes 5*h* are communicated together by annular gaskets 35*h* interposed between the heat transfer plates 20 which form the first flow path 1.

Then, a high-temperature fluid leak detection drain hole 5*d* and a low-temperature fluid leak detection drain hole 5*e* are formed below the leakage flow path 4 formed inside the peripheral gasket 33. As shown in FIG. 6, the high-temperature fluid leak detection drain hole 5*d* is placed adjacent to the high-temperature fluid drain hole 5*h* with a lower part of the first flow-path forming gasket 31*a* or a lower part of the outer gasket member 32*h*" therebetween. Also, the low-temperature fluid leak detection drain hole 5*e* is placed adjacent to the low-temperature fluid drain hole 5*c* with a lower part of the second flow-path forming gasket 31*b* or a lower part of the outer gasket member 32*c*" therebetween.

In the plate heat exchanger, the drain holes 5*h* are communicated together by the annular gaskets 35*h* while the drain holes 5*c* are communicated together by the annular gaskets 35*c*. That is, while being sandwiched between the adjacent heat transfer plates 20, the annular gaskets 35*h* and 35*c* isolate the drain holes 5*h* and 5*c*, respectively, from the first flow paths 1 and the second flow paths 2.

Each of the drain holes 5*c*, 5*h*, 5*d*, and 5*e* forms a drain channel 5*v* by means of the annular gasket 35*c* or 35*h* interposed between the adjacent heat transfer plates 20. The drain nozzles 8 continuous with the respective drain channels 5*v* are mounted on the fixed frame 11. A sensor may be mounted also on each drain nozzle 8 although not illustrated.

The plate heat exchanger according to the third embodiment configured as described above also exchanges heat between the high-temperature fluid H flowing through the first flow paths 1 and the low-temperature fluid C flowing through the second flow paths 2. Then, when the first flow-path forming gaskets 31*a* and the high-temperature-fluid communicating-path forming gaskets 32*h* in contact with the high-temperature fluid H degrade in a thermal load environment, it is possible to easily determine, by detecting the leaking high-temperature fluid Hm, that leakage of the high-temperature fluid Hm has occurred.

Figure 4:
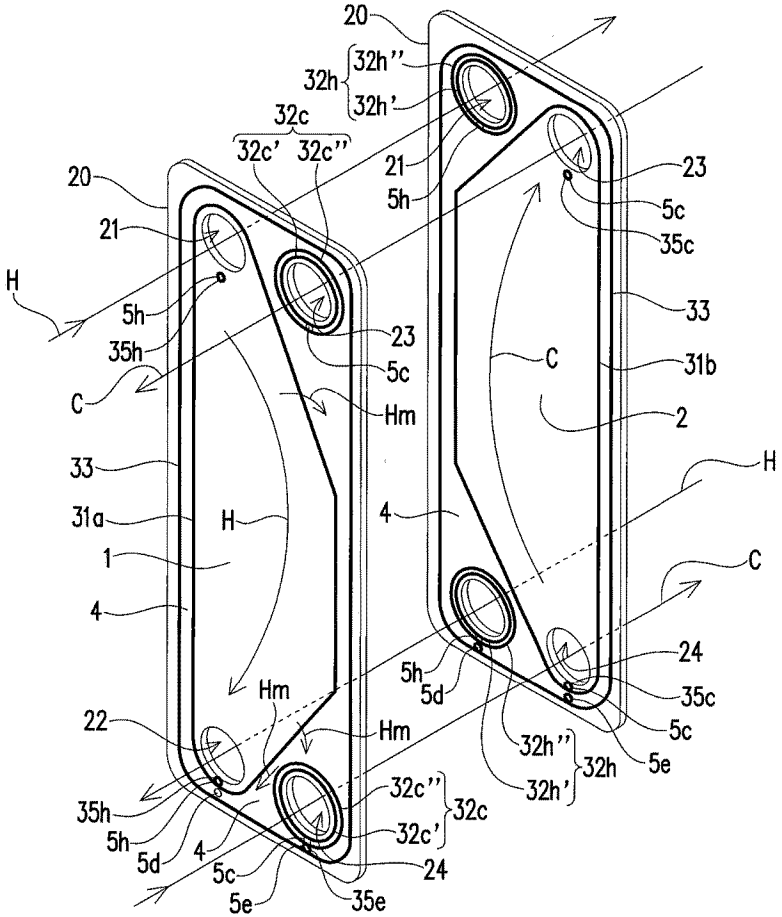
FIG. 4 is a schematic exploded perspective view showing principal part of the plate heat exchanger according to a third embodiment of the present invention.

For example, if any of the first flow-path forming gaskets 31*a* degrades and the high-temperature fluid Hm leaks out of the first flow path 1 into the leakage flow path 4 as shown in FIG. 4, the leaking high-temperature fluid Hm is discharged through the drain nozzle 8 after passing through the high-temperature fluid leak detection drain hole 5*d*. The leaking high-temperature fluid Hm does not flow into the low-temperature fluid leak detection drain hole 5*e* surrounded by an annular gasket 35*e*, and thus by detecting the high-temperature fluid Hm flowing out of the drain nozzle 8, it is possible to determine that leakage of the high-temperature fluid Hm has occurred due to degradation of the first flow-path forming gasket 31*a*.

Also, if the inner gasket member 32*h*' of the high-temperature-fluid communicating-path forming gasket 32*h* degrades as shown in FIG. 5C or if the annular gasket 35*h* surrounding the high-temperature fluid drain hole 5*h* degrades as shown in FIG. 5B, causing the high-temperature fluid Hm to leak, the leaking high-temperature fluid Hm is discharged through the drain nozzle 8.

Also, if the annular gasket 35*h* or the inner gasket member 32*h*' of the high-temperature-fluid communicating-path forming gasket 32*h* degrades as shown in FIG. 6B or if the first flow-path forming gasket 31*a* degrades as shown in FIG. 6C, the leaking high-temperature fluid Hm is discharged through the drain nozzle 8, making it possible to determine that leakage of the high-temperature fluid Hm has occurred due to degradation of the annular gasket 35*h* or the inner gasket member 32*h'*.

Fourth Embodiment

Figure 7:
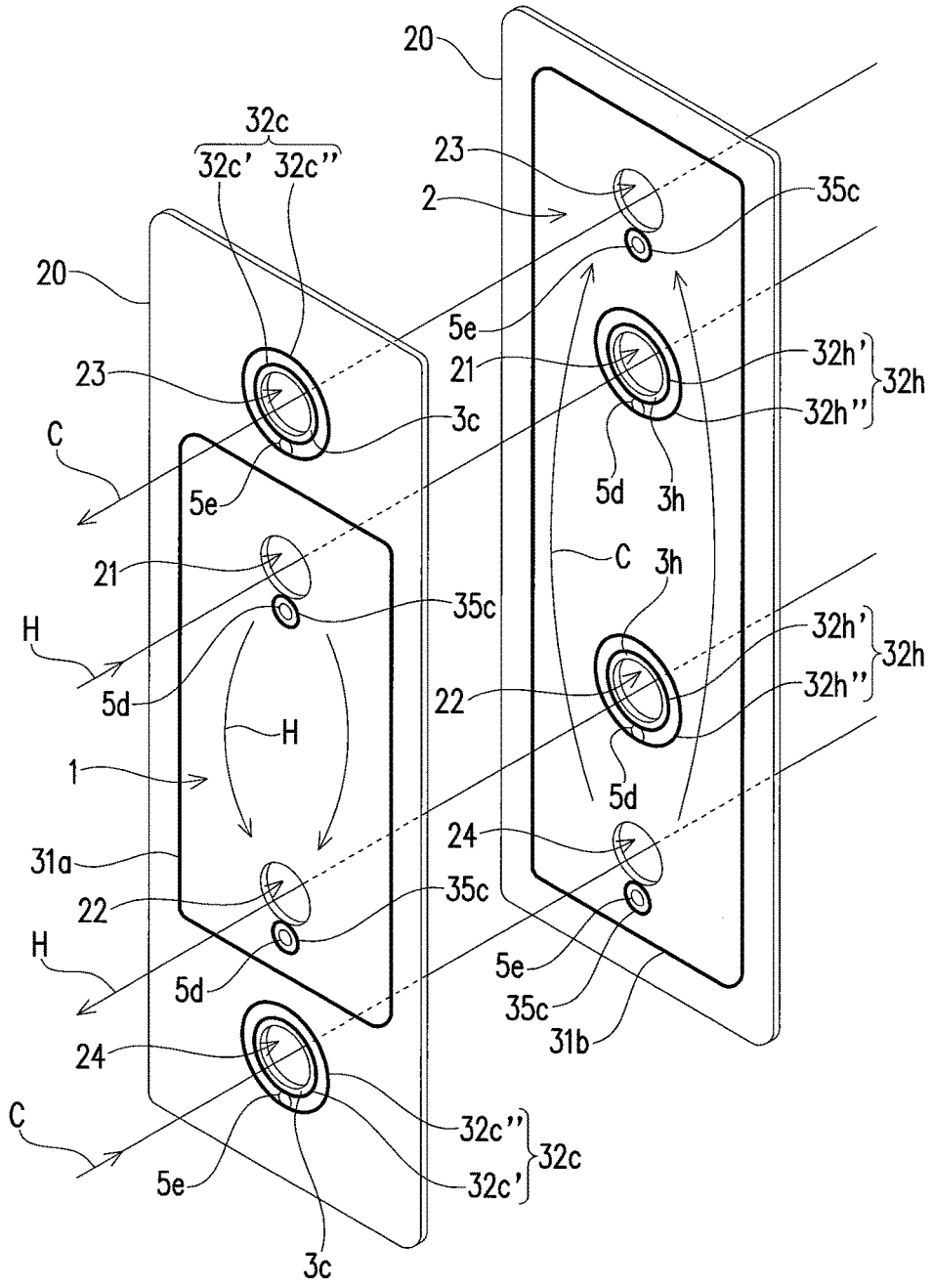
FIG. 7 is a schematic exploded perspective view showing principal part of the plate heat exchanger according to a fourth embodiment of the present invention.
Figure 8:
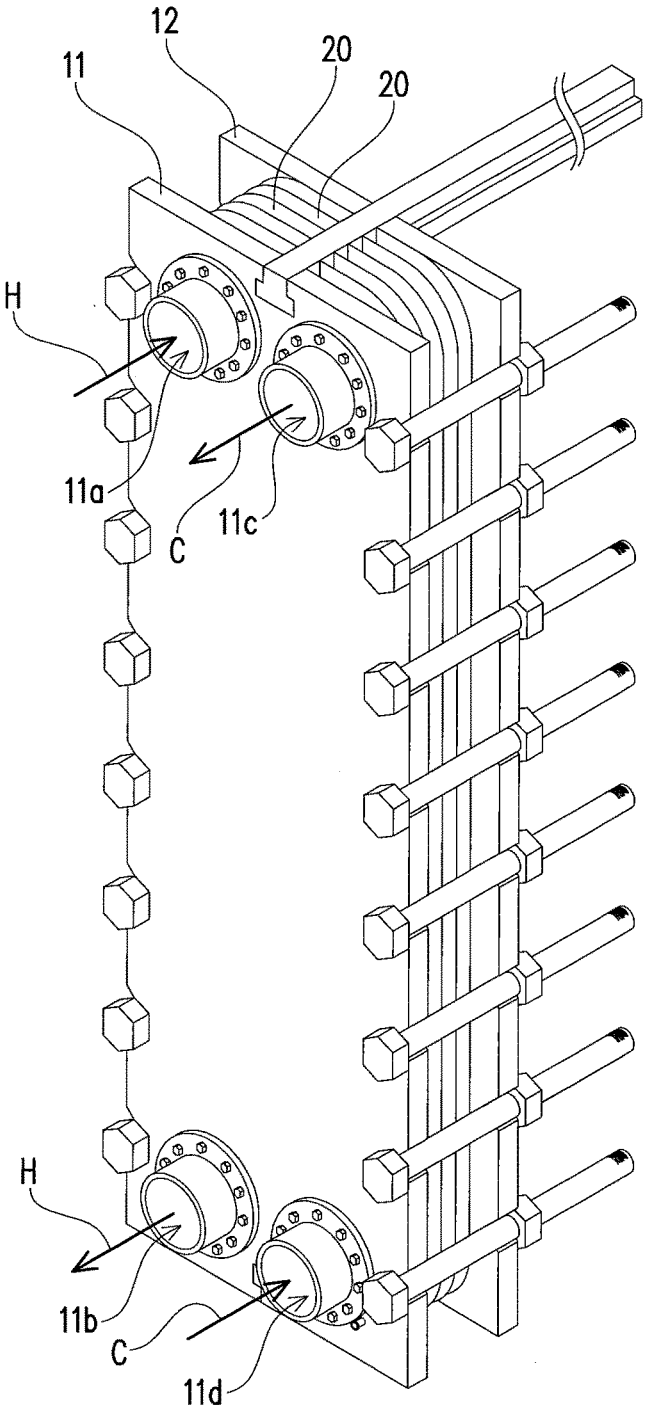
FIG. 8 is a schematic perspective view showing a conventional plate heat exchanger.
Figure 9:
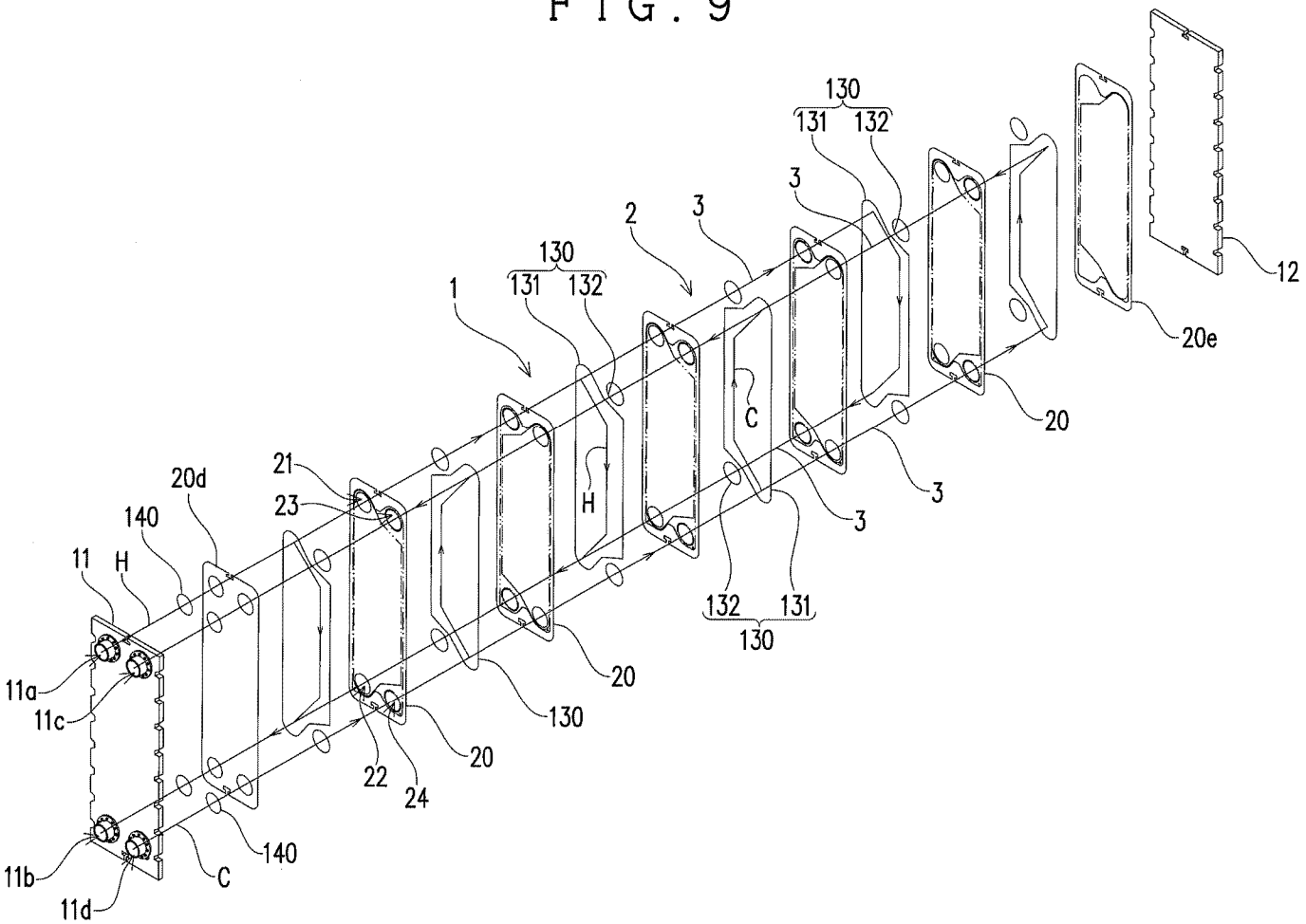
FIG. 9 is a schematic exploded perspective view showing the conventional plate heat exchanger.

Next, a plate heat exchanger according to a fourth embodiment of the present invention is described below with reference to FIG. 7. The same components as in the first to third embodiments are denoted by the same reference numerals as the corresponding components of the first to third embodiments.

In the plate heat exchanger according to the fourth embodiment, the passage holes 21 to 24 are arranged generally in a line (or maybe exactly in a line) in the upper and lower direction. The first flow path 1 adapted to pass the high-temperature fluid H is formed by the first flow-path forming gasket 31*a* which surrounds the two passage holes 21 and 22 on the inner side, but does not surround the two passage holes 23 and 24 on the outer side. On the other hand, the second flow path 2 adapted to pass the low-temperature fluid C is formed by the second flow-path forming gasket 31*b* which surrounds the four passage holes 21 to 24.

The two outer passage holes 23 and 24 located outside the first flow-path forming gasket 31*a* are surrounded by the respective low-temperature-fluid communicating-path forming gaskets 32*c*, thus forming low-temperature-fluid communicating paths 3*c*. Each of the low-temperature-fluid communicating-path forming gaskets 32*c* is a double-line gasket made up of the inner gasket member 32*c*' surrounding the passage hole 23 or 24 and the outer gasket member 32*c*" surrounding the inner gasket member 32*c*'. The low-temperature-fluid communicating path 3*c* adapted to pass the low-temperature fluid C is formed in the inner gasket member 32*c*' of the low-temperature-fluid communicating-path forming gasket 32*c*.

Also, the low-temperature fluid leak detection drain hole 5*e* is formed between the inner gasket member 32*c*' and the outer gasket member 32*c*", penetrating the heat transfer plate 20. Naturally, the low-temperature fluid leak detection drain hole 5*e* is formed also in the second flow path 2. In the second flow path 2, adjacent low-temperature fluid leak detection drain holes 5*e* are communicated together by the annular gasket 35*c* interposed between the adjacent heat transfer plates 20.

The two inner passage holes 21 and 22 in the second flow path 2 are surrounded by the respective high-temperature-fluid communicating-path forming gaskets 32*h*, thus forming the high-temperature-fluid communicating paths 3*h*. Each of the high-temperature-fluid communicating-path forming gaskets 32*h* is also a double-line gasket made up of the inner gasket member 32*h*' surrounding the passage hole 21 or 22 and the outer gasket member 32*h*" surrounding the inner gasket member 32*h*'. The high-temperature-fluid communicating path 3*h* adapted to pass the high-temperature fluid H is formed in the inner gasket member 32*h*' of the high-temperature-fluid communicating-path forming gaskets 32*h*.

The high-temperature fluid leak detection drain hole 5*d* is formed between the inner gasket member 32*h*' and the outer gasket member 32*h*". Naturally, the high-temperature fluid leak detection drain hole 5*d* is also formed in the first flow path 1. In the first flow path 1, adjacent high-temperature fluid leak detection drain holes 5*d* are communicated together by the annular gasket 35*c*.

A communicating hole (not shown) continuous with the low-temperature fluid leak detection drain hole 5*e* and the high-temperature fluid leak detection drain hole 5*d* is formed in the fixed frame (not shown) and a drain nozzle (not shown) is mounted in the communicating hole.

The plate heat exchanger according to the fourth embodiment also exchanges heat between the high-temperature fluid H flowing through the first flow paths 1 and the low-temperature fluid C flowing through the second flow paths 2.

When the inner gasket members 32*h*' of the high-temperature-fluid communicating-path forming gasket 32*h* is degraded by the high-temperature fluid H flowing through the high-temperature-fluid communicating path 3*h*, the high-temperature fluid Hm leaks out of the inner gasket member 32*h*', but does not leak into the second flow path 2 because of the outer gasket member 32*h*", and the leaking high-temperature fluid Hm is discharged through the drain nozzle by moving through the annular gasket 35*c*.

Also, when the inner gasket member 32*c*' of the low-temperature-fluid communicating-path forming gasket 32*c* is degraded by the low-temperature fluid C flowing through the low-temperature-fluid communicating path 3*c*, low-temperature fluid Cm leaks out of the inner gasket member 32*c*', but does not leak outside because of the outer gasket member 32*c*", and the leaking low-temperature fluid Cm is discharged through the drain nozzle by moving through the annular gasket 35*c*.

In this way, by detecting that the high-temperature fluid Hm or the low-temperature fluid Cm leaking from the drain nozzle is being discharged, it possible to determine that leakage of the high-temperature fluid Hm or the low-temperature fluid Cm has occurred due to degradation of the inner gasket member 32*h*' or 32*c'*.

Thus, in the plate heat exchanger according to the present embodiment, the plurality of heat transfer plates 20 are stacked, each being provided with the plurality of passage holes 21, 22, 23, and 24; the flow-path forming gasket 31*a* or 31*b* is interposed between peripheries of each adjacent ones of the heat transfer plates 20, thereby alternately forming the first flow path 1 adapted to pass the high-temperature fluid H and the second flow path 2 adapted to pass the low-temperature fluid C on opposite sides of each heat transfer plate 20; the communicating-path forming gaskets 32*c* and 32*h* surrounding the passage holes 21, 22, 23, and 24 are interposed between adjacent ones of the heat transfer plates 20, thereby forming the communicating path 3 adapted to cause the fluid H to flow in and out of the first flow path 1 and the communicating path 3 adapted to cause the fluid C to flow in and out the second flow path 2; the drain holes 5*c*, 5*e*, 5*d*, 5*h*, 6, 6*a*, and 6*b* are formed in each of the heat transfer plates 20 to discharge fluid Hm or Cm leaking from the first flow path 1, the second flow path 2, or the communicating path 3; and the drain holes 5*c*, 5*e*, 5*d*, 5*h*, 6, 6*a*, and 6*b* are surrounded by the plurality of gaskets 31*a*, 31*b*, 32*c*, 32*h*, 33, 34, 35*c*, 35*d*, 35*e*, and 35*h*, thus forming the leakage flow path 4 or the leakage collector 5*a* or 5*b* isolated from the first flow path 1, the second flow path 2, or the communicating path 3. Consequently, the leakage flow path 4 or the leakage collector 5*a* or 5*b* including the drain holes 5*c*, 5*e*, 5*d*, 5*h*, 6, 6*a*, and 6*b* are formed by the plurality of gaskets 31*a*, 31*b*, 32*c*, 32*h*, 33, 34, 35*c*, 35*d*, 35*e*, and 35*h*, and when the first flow-path forming gasket 31*a*, the second flow-path forming gasket 31*b*, or the communicating-path forming gasket 32*c* or 32*h* degrades in a thermal load environment, causing the fluid H or C to leak from the gasket 31*a* or 31*b* of the first flow path 1, the second flow path 2, or the communicating path 3, the fluid H or C flows into the drain holes 5*c*, 5*e*, 5*d*, 5*h*, 6, 6*a*, and 6*b* through the leakage flow path 4 or the leakage collector 5*a* or 5*b* and is discharged through the drain holes 5*c*, 5*e*, 5*d*, 5*h*, 6, 6*a*, and 6*b*, making it possible to detect liquid leakage of the high-temperature fluid H due to degradation of the gaskets.

Also, in the plate heat exchanger according to the present embodiment, the leakage flow path 4 is formed between the first flow-path forming gasket 31*a* and the peripheral gasket 33 which surrounds the entire circumference of the first flow-path forming gasket 31*a*. This not only allows the leakage flow path 4 to be formed between the peripheral gasket 33 and the first flow-path forming gasket 31*a*, but also keeps the outer side of the first flow-path forming gasket 31*a* from contact with the atmosphere by means of the peripheral gasket 33, making the first flow-path forming gasket 31*a* less prone to degradation.

Also, in the plate heat exchanger according to the present embodiment, the leakage collectors 5*a* and 5*b* are formed between the communicating-path forming gaskets 32*c* and 32*h* and a set of the second flow-path forming gasket 31*b* and the local gasket 34 surrounding the communicating-path forming gaskets 32*c* and 32*h*. This not only allows the leakage collectors 5*a* and 5*b* to be formed by the second flow-path forming gasket 31*b* and the local gasket 34 which surround the first flow-path forming gasket 31*a*, but also keeps the outer side of the first flow-path forming gasket 31*a* from contact with the atmosphere by means of the local gasket 34, making the first flow-path forming gasket 31*a* less prone to degradation.

Also, in the plate heat exchanger according to the present embodiment, each of the communicating-path forming gaskets 32*c* and 32*h* is a double-line gasket made up of the inner gasket member 32*c*' or 32*h*' and the outer gasket member 32*c*" or 32*h*"; the drain holes 5*c*, 5*e*, 5*d*, 5*h*, 6, 6*a*, 6*b* are formed between the inner gasket member 32*c*' or 32*h*' and the outer gasket member 32*c*" or 32*h*"; the leakage flow path 4 is provided between the inner gasket member 32*c*' or 32*h*' and the outer gasket member 32*c*" or 32*h*"; and the drain holes 5*c*, 5*e*, 5*d*, 5*h*, 6, 6*a*, 6*b* exposed to the first flow path 1 or the second flow path 2 by being located next to the leakage flow path 4 are communicated together by the annular gasket 35*c*, 35*d*, 35*e*, or 35*h*. Since each of the communicating-path forming gaskets 32*c* and 32*h* is a double-line gasket made up of the inner gasket member 32*c*' or 32*h*' and the outer gasket member 32*c*" or 32*h*", even when fluid leaks out of the inner gasket member 32*c*' or 32*h*' due to degradation of the inner gasket member 32*c*' or 32*h*', fluid does not leak out of the outer gasket member 32*c*" or 32*h*", and can be discharged to the leakage flow path 4 through the drain holes 5*c*, 5*e*, 5*d*, 5*h*, 6, 6*a*, 6*b*. Since the drain holes 5*c*, 5*e*, 5*d*, 5*h*, 6, 6*a*, 6*b* are communicated together by the annular gasket 35*c*, 35*d*, 35*e*, or 35*h* in the adjacent first flow path 1 or second flow path 2, the fluid leaking out of the inner gasket member 32*c*' or 32*h*' does not flow into the first flow path 1 or the second flow path 2.

Also, in the plate heat exchanger according to the present embodiment, the fluid supply hole 7 is formed in the heat transfer plate 20 to supply a third fluid into the leakage flow path 4 or the leakage collectors 5*a* and 5*b*. Since the third fluid is supplied from the fluid supply hole 7 to the leakage flow path 4 or the leakage collectors 5*a* and 5*b*, it is possible to expel oxygen from the air initially existing in the leakage flow path 4 or the leakage collectors 5*a* and 5*b*. Note that an inert gas such as nitrogen, or pure water can be used as the third fluid.

Also, in the plate heat exchanger according to the present embodiment, the drain channel 5*v* continuous with the drain holes 5*c*, 5*e*, 5*d*, 5*h*, 6, 6*a*, 6*b* is formed in one of the fixed frame 11 and the movable frame 12 which sandwich the plurality of stacked heat transfer plates 20; the drain nozzle 8 is mounted on the drain channel 5*v*; and a sensor adapted to detect a fluid is connected to the drain nozzle 8. This makes it possible to detect any leakage of fluid from the drain nozzle 8. The sensor accurately detects, for example, any or all of the temperature, pressure, leakage amount, and components of the leaking fluid, and thereby allows proper remedial measures to be taken.

Also, in the plate heat exchanger according to the present embodiment, the passage holes 21, 22, 23, and 24 are formed in respective corners of the heat transfer plate 20. Consequently, for example, in a certain heat transfer plate 20, if the upper left passage hole 21 is used as an inlet of the high-temperature fluid H and the lower left passage hole 22 is used as an outlet of the high-temperature fluid H, the high-temperature fluid H flows from the upper part to the lower part of the heat transfer plate 20. Also, in adjacent heat transfer plates 20, if the lower right passage hole 24 is used as an inlet of the low-temperature fluid C and the upper right passage hole 23 is used as an outlet of the low-temperature fluid C, the low-temperature fluid C flows from the lower part to the upper part of the heat transfer plate 20. This makes it possible to exchange heat efficiently between the high-temperature fluid H and the low-temperature fluid C.

Also, in the plate heat exchanger according to this fourth embodiment, the passage holes 21, 22, 23, and 24 are formed generally in a line in the length direction of the heat transfer plate 20. Consequently, upper inner, lower inner, lower outer, and upper outer passage holes 21, 22, 24, and 23 are formed in a line. For example, in a certain heat transfer plate 20, if the upper inner passage hole 21 is used as an inlet of the high-temperature fluid H and the lower inner passage hole 22 is used as an outlet of the high-temperature fluid H, the high-temperature fluid H flows from the upper inner part to the lower inner part of the heat transfer plate 20. Also, in adjacent heat transfer plates 20, if the lower outer passage hole 24 is used as an inlet of the low-temperature fluid C and the upper outer passage hole 23 is used as an outlet of the low-temperature fluid C, the low-temperature fluid C flows from the lower outer part to the upper outer part of the heat transfer plate 20. This makes it possible to exchange heat efficiently between the high-temperature fluid H and the low-temperature fluid C. Note that the phrase "generally in a line" includes "exactly in a line."

Other Embodiments

The present invention is not limited to the embodiments described above and various changes can be made to the embodiments. For example, the low-temperature-fluid communicating-path forming gasket 32*c* and the high-temperature-fluid communicating-path forming gaskets 32*h* may adopt double-line gaskets in the first and second embodiment as well. On the other hand, the low-temperature-fluid communicating-path forming gasket 32*c* according to the third and fourth embodiments may be a single-line gasket. Also, the communicating hole continuous with the low-temperature fluid leak detection drain hole 5*e* and the high-temperature fluid leak detection drain hole 5*d* may be provided in the movable frame rather than in the fixed frame 11.

REFERENCE SIGNS LIST

1 . . . First flow path
2 . . . Second flow path
3 . . . Communicating path
3*c* . . . Low-temperature-fluid communicating-path
3*h* . . . High-temperature-fluid communicating-path
4 . . . Leakage flow path
5*a* . . . First leakage collector
5*b* . . . Second leakage collector
5*c*, 5*e* . . . Low-temperature fluid leak detection drain hole
5*d*, 5*h* . . . High-temperature fluid leak detection drain hole
5*v* . . . Drain channel
6, 6*a*, 6*b* . . . Drain hole
7 . . . Fluid supply hole
8 . . . Drain nozzle
9 . . . Fluid supply nozzle
11 . . . Fixed frame
12 . . . Movable frame
20 . . . Heat transfer plate
21, 22, 23, 24 . . . Passage hole
31*a* . . . First flow-path forming gasket
31*b* . . . Second flow-path forming gasket
32*a* . . . Inner gasket member
32*b* . . . Flow-path forming gasket
32*c* . . . Low-temperature-fluid communicating-path forming gasket
32*c*' . . . Inner gasket member
32*c*" . . . Outer gasket member
32*h* . . . High-temperature-fluid communicating-path forming gasket
32*h*' . . . Inner gasket member
32*h*" . . . Outer gasket member
33 . . . Peripheral gasket
34 . . . Local gasket
35*c*, 35*d*, 35*e*, 35*h* . . . Annular gasket
C . . . Low-temperature fluid
Cm . . . Leaking low-temperature fluid and low-temperature fluid likely to leak
H . . . High-temperature fluid
Hm . . . Leaking high-temperature fluid and high-temperature fluid likely to leak

What is claimed is:

1. A plate heat exchanger wherein:

a plurality of heat transfer plates are stacked, each being provided with a plurality of passage holes;

a flow-path forming gasket is interposed between peripheries of each adjacent ones of the plurality of heat transfer plates, thereby alternately forming a first flow path adapted to pass a high-temperature fluid and a second flow path adapted to pass a low-temperature fluid on opposite sides of each heat transfer plate;

communicating-path forming gaskets surrounding the passage holes are each interposed between each adjacent ones of the plurality of heat transfer plates, thereby forming a communicating path adapted to cause a fluid to flow in and out of the first flow path and a communicating path adapted to cause a fluid to flow in and out the second flow path;

a drain hole is formed in each of the heat transfer plates to discharge fluid leaking from the first flow path, the second flow path, or the communicating path; and the drain hole is isolated from the first flow path, the second flow path, or the communicating path by a plurality of gaskets, forming a leakage flow path or a leakage collector, and an entire circumference of a first flow-path forming gasket which forms the first flow path is surrounded by a peripheral gasket; and the leakage flow path is formed between the first flow-path forming gasket and the peripheral gasket.

2. The plate heat exchanger according to claim 1, wherein each of the communicating-path forming gaskets is a double-line gasket made up of an inner gasket member and an outer gasket member; the drain hole is formed between the inner gasket member and the outer gasket member; the leakage flow path is provided between the inner gasket member and the outer gasket member; and the drain holes exposed to the first flow path or the second flow path by being located next to the leakage flow path are communicated together by an annular gasket.

3. The plate heat exchanger according to claim 1, wherein the passage holes are formed in respective corners of the heat transfer plate.

4. A plate heat exchanger wherein:

a plurality of heat transfer plates are stacked, each being provided with a plurality of passage holes;

a flow-path forming gasket is interposed between peripheries of each adjacent ones of the plurality of heat transfer plates, thereby alternately forming a first flow path adapted to pass a high-temperature fluid and a second flow path adapted to pass a low-temperature fluid on opposite sides of each heat transfer plate;

communicating-path forming gaskets surrounding the passage holes are each interposed between each adjacent ones of the plurality of heat transfer plates, thereby forming a communicating path adapted to cause a fluid to flow in and out of the first flow path and a communicating path adapted to cause a fluid to flow in and out the second flow path;

a drain hole is formed in each of the heat transfer plates to discharge fluid leaking from the first flow path, the second flow path, or the communicating path; and the drain hole is isolated from the first flow path, the second flow path, or the communicating path by a plurality of gaskets, forming a leakage flow path or a leakage collector, and a fluid supply hole is formed in the heat transfer plate to supply a third fluid into the leakage flow path or the leakage collector.

5. The plate heat exchanger according to claim 4, wherein respective communicating-path forming gaskets are enclosed by a second flow-path forming gasket adapted to form the second flow path and a local gasket; and the leakage collector is formed among the respective communicating-path forming gaskets, the second flow-path forming gasket, and the local gasket.

6. A plate heat exchanger wherein:

a plurality of heat transfer plates are stacked, each being provided with a plurality of passage holes;

a flow-path forming gasket is interposed between peripheries of each adjacent ones of the plurality of heat transfer plates, thereby alternately forming a first flow path adapted to pass a high-temperature fluid and a second flow path adapted to pass a low-temperature fluid on opposite sides of each heat transfer plate;

communicating-path forming gaskets surrounding the passage holes are each interposed between each adjacent ones of the plurality of heat transfer plates, thereby forming a communicating path adapted to cause a fluid to flow in and out of the first flow path and a communicating path adapted to cause a fluid to flow in and out the second flow path;

a drain hole is formed in each of the heat transfer plates to discharge fluid leaking from the first flow path, the second flow path, or the communicating path; and the drain hole is isolated from the first flow path, the second flow path, or the communicating path by a plurality of gaskets, forming a leakage flow path or a leakage collector, and a drain channel continuous with the drain hole is formed in one of a fixed frame and a movable frame which sandwich the plurality of stacked heat transfer plates; a drain nozzle is mounted on the drain channel; and a sensor adapted to detect a fluid is connected to the drain nozzle.

* * * * *